US007059902B2

(12) United States Patent
Nakamura

(10) Patent No.: US 7,059,902 B2
(45) Date of Patent: Jun. 13, 2006

(54) CONNECTOR, A CONNECTOR ASSEMBLY AND A METHOD OF ASSEMBLING A CONNECTOR ASSEMBLY

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/931,662

(22) Filed: Sep. 1, 2004

(65) Prior Publication Data

US 2005/0042921 A1 Feb. 24, 2005

(30) Foreign Application Priority Data

Sep. 4, 2003 (JP) ..... 2003-312992

(51) Int. Cl.
*H01R 13/40* (2006.01)

(52) U.S. Cl. ..... 439/595; 439/752; 439/489

(58) Field of Classification Search ..... 439/595, 439/752, 157, 347, 188, 488–489, 350–358, 439/137–141

See application file for complete search history.

(56) References Cited

U.S. PATENT DOCUMENTS 6,530,800 B1 * 3/2003 Nakamura ..... 439/352
6,712,635 B1 * 3/2004 Nimura ..... 439/352
6,749,469 B1 * 6/2004 Matsuoka ..... 439/752
6,824,417 B1 * 11/2004 Nimura ..... 439/352

FOREIGN PATENT DOCUMENTS

JP 11-167950 6/1999

* cited by examiner

*Primary Examiner*—Gary F. Paumen
*Assistant Examiner*—Edwin A. Leon
(74) *Attorney, Agent, or Firm*—Gerald E. Hespos; Anthony J. Casella

(57) ABSTRACT

A male housing (60) has a receptacle (61) for receiving a mating female housing (20) and cavities (63) for receiving male terminal fittings (50). A retainer (70) is mounted in the male housing (60) and locks the male terminal fittings (50) when the retainer (70) reaches a full locking position. The retainer (70) has a detector (74). The detector (74) is in a fitting space (64) of the receptacle (61) for the female housing (20) when the retainer (70) is at a position before the full locking position, and interferes with a rib (24) of the female housing (20) to prevent a connecting operation. On the other hand, the detector (74) is outside the fitting space (64) when the retainer (70) is at the full locking position thereby avoiding the interference with the rib (24) of the female housing (20) to permit connection.

8 Claims, 22 Drawing Sheets

FIG. (9A)
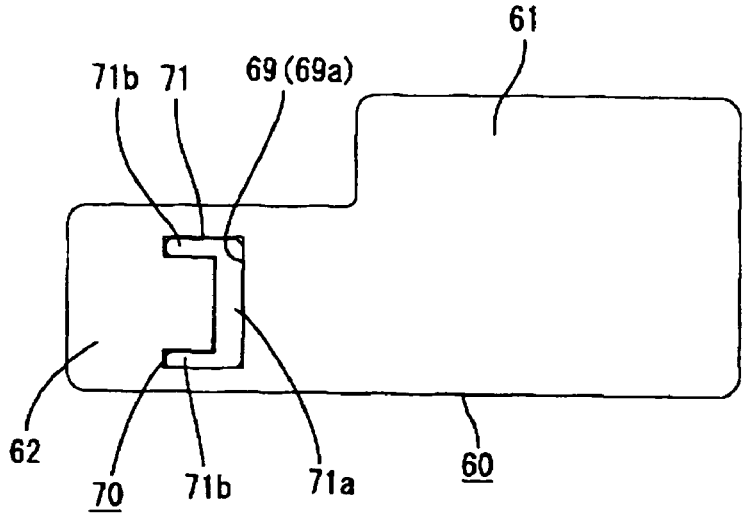
FIG. (9B)
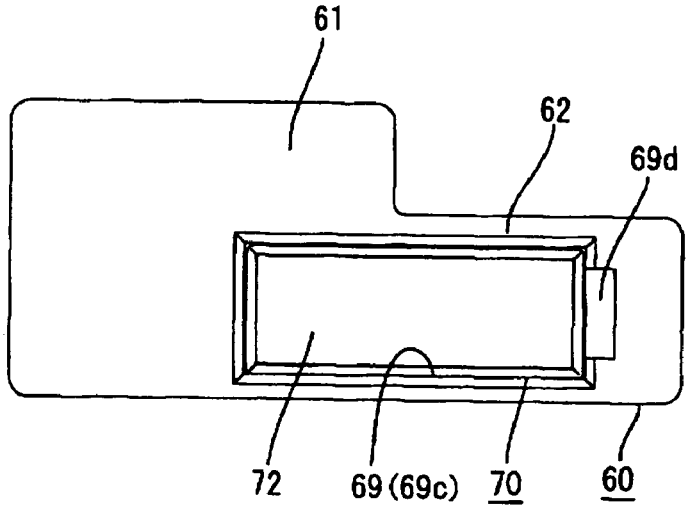

CONNECTOR, A CONNECTOR ASSEMBLY AND A METHOD OF ASSEMBLING A CONNECTOR ASSEMBLY

BACKGROUND OF THE INVENTION

1. Field of the Invention

The invention relates to a connector with a retainer.

2. Description of the Related Art

Japanese Unexamined Patent Publication No. 11-167950 and FIG. 22 herein disclose a male connector with a retainer for locking male terminal fittings in a housing. With reference to FIG. 22, a connector assembly includes a female housing 1 that can be received in a receptacle 2 of a male housing 3. A retainer 4 is mounted in the male housing 3 to engage and lock male terminal fittings that have been accommodated properly in the male housing 3. The receptacle 2 of the male housing 3 has a fitting space 6 for receiving the female housing 1, and the retainer 4 has a detector 7 that normally is in the fitting space 6 of the receptacle 2. The female housing 1 has an escaping groove 8 that receives the detector 7 when the retainer 4 is in a proper mount position. However, the retainer 4 might not be moved completely to the proper mount position. In this situation, the detector 7 will not align with the escape groove 8 of the female housing 1, and will hinder connection of the female housing 1. In this way, incomplete mounting of the retainer 4 can be detected.

A demand exists for miniature connector assemblies. However, the escaping groove 8 of the above-described connector assembly requires space and complicates attempts to miniaturize the connector assembly. Thus, there has been a limit in miniaturization of the above-described connector assembly.

The present invention was developed in view of the above problem and an object thereof is to allow a connector to be suitably miniaturized.

SUMMARY OF THE INVENTION

The invention relates to a connector assembly with male and female housings. The male housing has a receptacle with a fitting space for receiving the female housing. Male terminal fittings are accommodated in the male housing, and a retainer is mountable in the male housing to lock the male terminal fittings that have reached a proper mount position. The retainer has a detector that is in the fitting space of the receptacle before the retainer has reached the proper mount position. Thus, the detector interferes with the female housing and prevents connection of the housings before the retainer has reached the proper mount position. However, the detector is not in the fitting space and permits connection of the housings when the retainer is at the proper mount position. The ability or inability to complete a connection of the male and female housings provides an indication of whether or not the retainer has reached the proper mount position.

The detector is not in the fitting space when the retainer is at the proper mount position. Thus, the female housing does not need an escaping groove to receive the detector, and the connector is miniaturized more easily.

The receptacle preferably has at least one rib insertion groove for receiving a rib of the mating male housing. The detector preferably is in the rib insertion groove when the retainer is before the proper mount position. Thus, the rib interferes with the detector and prevents the connection. However, the detector is not in the rib insertion groove when the retainer is at the proper mount position. Thus, the rib can enter the rib insertion groove without interference with the detector when the retainer is at the proper mount position and the connection of the housings is permitted.

The retainer preferably is movable along a direction intersecting the inserting and withdrawing directions of the male terminal fittings. More particularly, the retainer can be moved between a partial locking position where insertion and withdrawal of the male terminal fittings into and from the male housing are permitted and a full locking position where the retainer locks the male terminal fittings.

The detector preferably is in the fitting space when the retainer is before the full locking position and is outside the fitting space when the retainer reaches the full locking position.

The male housing preferably has a cut-away portion for receiving the detector when the retainer is mounted.

The detector preferably is at a front side of the retainer with respect to a mounting direction of the retainer into the male housing and/or with respect to a connecting and separating direction of the housings. Thus, an area where the cut-away portion is formed can be small as compared to a case where the detector is at a back end of the retainer with respect to the mounting direction of the retainer and/or with respect to a connecting and separating direction. Accordingly, an area where the cut-away portion is formed can be small and the male housing can be strong.

A locking construction preferably is provided for locking the male housing and the mating female housing together.

The invention also relates to a connector assembly that comprises the above-described connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTION OF THE DRAWINGS

FIGS. 9(A) and 9(B) are a left side view and a right side view of the male housing having the retainer mounted therein.

DETAILED DESCRIPTION OF THE PREFERRED EMBODIMENTS

A connector assembly according to the invention is described with reference to FIGS. 1 to 21. The connector assembly includes a male connector M that can be mated with a female connector F. In the following description, engaging sides of the connectors M, F are referred to as the front, and reference is made to the respective figures except FIGS. 2, 4, 17 and 20 concerning the vertical direction.

Figure 3:
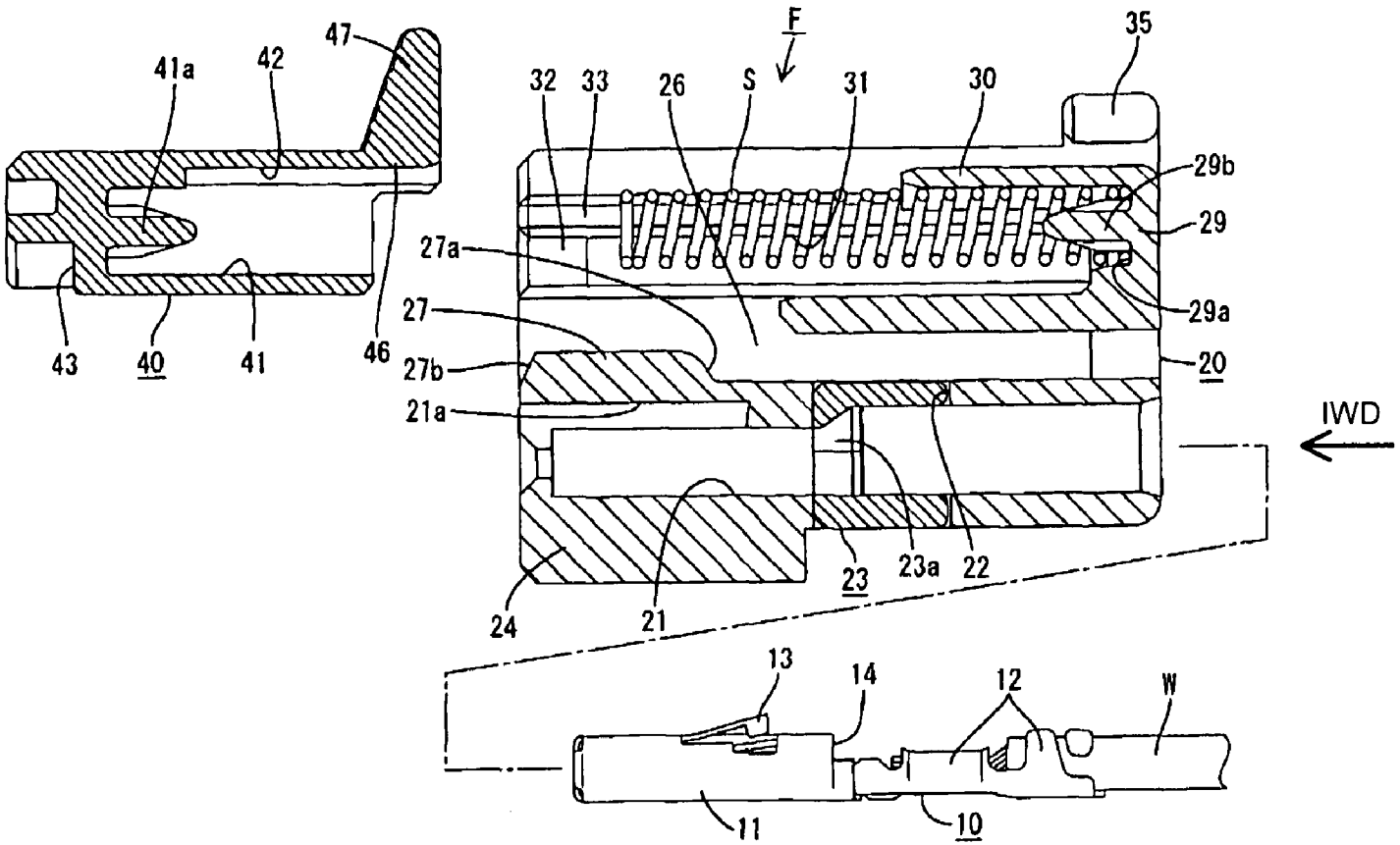
FIG. 3 is a section along 3—3 of FIG. 1.

The female connector F has a female housing 20 for accommodating the female terminal fittings 10 and a retainer 23 for locking the female terminal fittings 10, as shown in FIG. 3. Each female terminal fitting 10 includes a substantially box-shaped main portion 11 and a barrel 12 to be crimped, bent or folded into connection with an end of a wire W. The main portion 11 and the barrel 12 are coupled one after the other. A cut is made in the upper surface of the main portion 11 and is bent to form a cantilevered lock 13 that is resiliently deformable vertically towards and away from the main portion 11.

Figure 1:
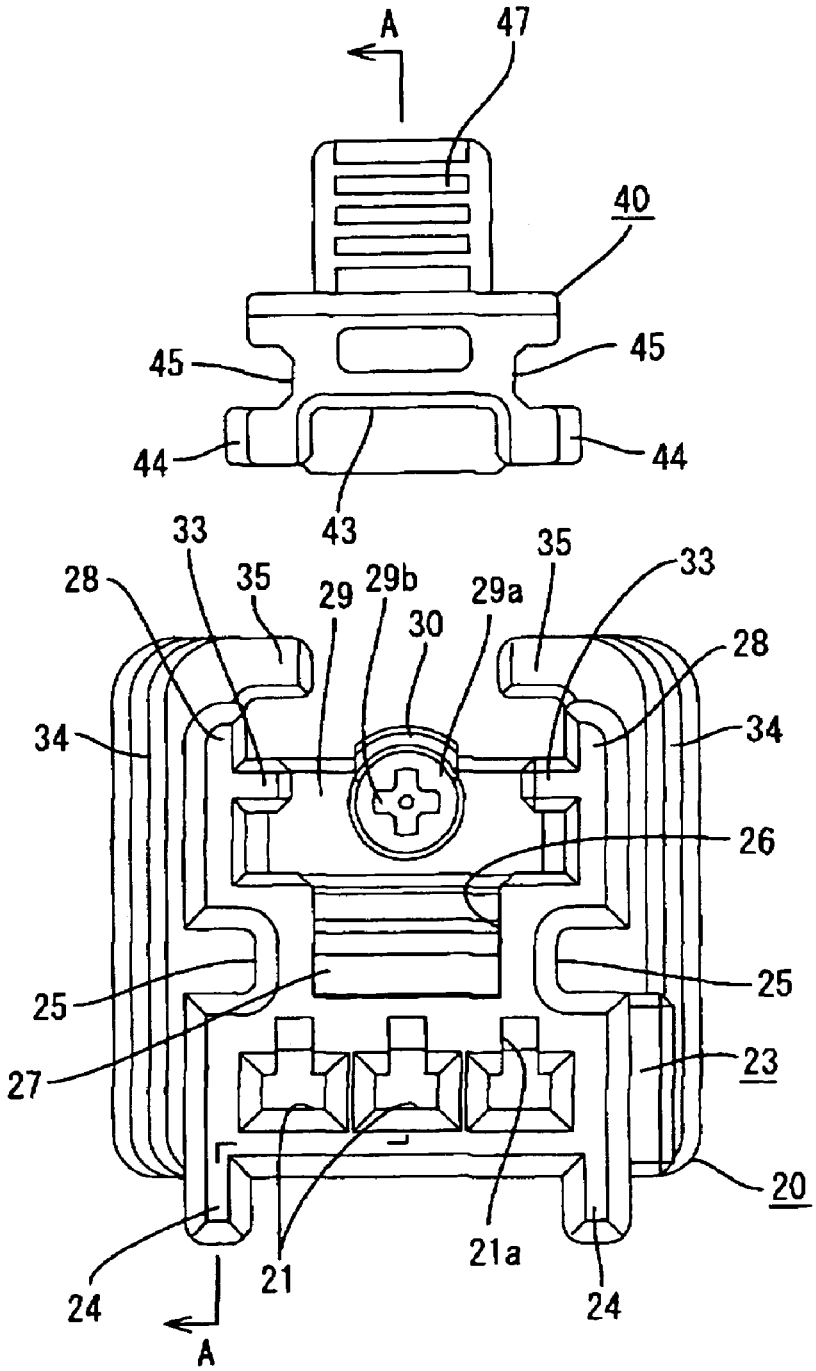
FIG. 1 is an exploded front view showing a female housing having a retainer mounted at a partial locking position and a slider according to one embodiment of the invention.

The female housing 20 is made e.g. of a synthetic resin and has cavities 21 arranged substantially side by side along a widthwise direction, as shown in FIGS. 1 and 3. A forwardly open lock insertion groove 21*a* is formed in the ceiling surface of each cavity 21. The female terminal fittings 10 are insertable from behind into the cavities 21. The lock 13 of each female terminal fitting 10 can enter the lock insertion groove 21*a* to engage the rear surface of the insertion groove 21*a*. A downwardly open retainer mount hole 22 is formed in the female housing 20 and crosses the cavities 21. The retainer 23 is mounted sideways (right side of FIG. 1) into the retainer mount hole 22 and is movable widthwise along a direction intersecting the inserting and withdrawing directions IWD of the female terminal fittings 10. The retainer 23 can be moved between a partial locking position (see FIG. 3) and a full locking position (see FIG. 11). Fastening portions 23*a* are retracted from the cavities 21 when the retainer 23 is in the partial locking position to permit insertion and withdrawal of the female terminal fittings 10 into and from the cavities 21. However, the fastening portions 23*a* are in the cavities 21 when the retainer 23 is in the full locking position to engage jaws 14 of the main portions 11 of the female terminal fittings 10. The retainer 23 projects out from the outer surface of the female housing 20 at the partial locking position (see FIGS. 4 and 5), whereas the outer surface of the retainer 23 is flush with the outer side surface of the female housing 20 at the full locking position (see FIG. 17). A construction for holding the retainer 23 is similar to the construction for holding the retainer of the male connector M, as described later.

Ribs 24 project down from the opposite lateral edges of the bottom surface of the female housing 20 for guiding the connection of the connectors M, F. The front end surfaces of the ribs 24 are substantially flush with the front surface of the female housing 20. However, the ribs 24 have lengths that are less than the lengths of the female housing 20, and preferably are less than half the length of the female housing 20. Rib insertion grooves 25 are formed in the opposite outer side surfaces of the female housing 20 for guiding connection of the connectors M, F.

An escaping portion 26 is formed substantially in the widthwise middle of the upper surface of the female housing 20. A front part of the escaping portion 26 opens forward and upward, whereas a rear part thereof is slightly lower than the front part and opens backward. Accordingly, a lock 27 is left before the rear part of the escaping portion 26. A front surface 27*b* of the lock 27 is sloped up and to the back, whereas a rear locking surface 27*a* is substantially arcuate and slopes down and to the back.

Two sidewalls 28 extend forward and backward at opposite lateral edges of the upper surface of the female housing 20 and a rear wall 29 extends between the rear ends of the sidewalls 28. A slider 40 and a compression coil spring S can be mounted from the front into a space partly surrounded by the sidewalls 28 and the rear wall 29. The mounted slider 40 is slidable forward and backward substantially along connecting and separating directions CSD of the two housings 20, 60. The compression coil spring S is supported by having its rear end fit into a spring fitting groove 29*a* in the rear wall 29. A spring-inserting projection 29*b* projects from the inside of the spring fitting groove 29*a* and is inserted into the rear end of spring S. A substantially widthwise middle of the rear wall 29 projects up along the spring fitting groove 29*a*, and a covering wall 30 extends forward from this projecting portion for covering the compression coil spring S from above.

Figure 2:
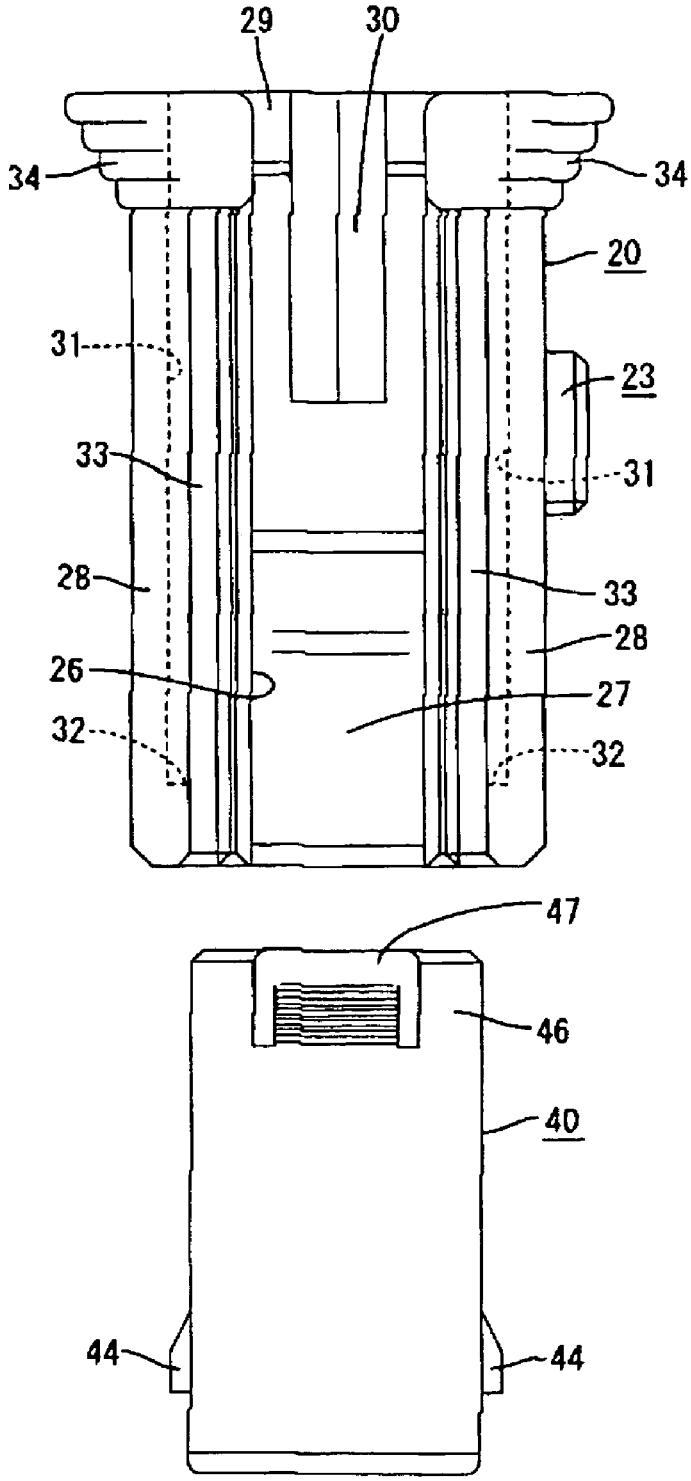
FIG. 2 is an exploded plan view showing the female housing having the retainer mounted at the partial locking position and the slider.

Rearwardly open escaping grooves 31 are formed in the facing inner surfaces of the bottom ends of both side walls 28, as shown in FIGS. 2 and 3, for receiving front-stops 44 on the slider 40. The slider 40 can be held at its front end position by the engagement of receiving portions 32 at the front sides of the escaping grooves 31 with the front-stops 44 (see FIG. 5). Supports 33 bulge in at an intermediate portion of the sidewalls 28 with respect to the height, as shown in FIGS. 1 and 3, for supporting arms 46 of the slider 40. The supports 33 are rails that extend forward and back over substantially the entire length of the sidewalls 28. The rear ends of the supports 33 are coupled to the rear wall 29 and the upper surfaces of the supports 33 substantially align with the upper surface of the rear wall 29. Two housing operating portions 34 bulge out at the rear ends of both sidewalls 28 as shown in FIGS. 1 and 2. The housing operating portions 34 are stepped to bulge out more towards the rear end to make it easier to pull the female housing 20 back. Upper ends of the operating portions 34 are higher than upper ends of the sidewalls 28. Two restricting portions 35 bulge in from the facing surfaces of the upper ends of the housing operating portions 34 to restrict upward displacement of the arms 46 of the slider 40. The lower surfaces of the restricting portions 35 are at a height to slide in contact with the upper surface of the slider 40 and face the upper surface of the female housing 20 (see FIG. 11). A distance between the restricting portions 35 is set to permit the entrance of a slider-operating portion 47 of the slider 40 between the restricting portions 35. In a connected state of the two housings 20, 60, the restricting portions 35 are outside the receptacle 61 and face the upper part of the receptacle 61 substantially along forward and backward directions (see FIG. 15).

The slider 40 is made e.g. of a synthetic resin and is substantially block-shaped. At least one spring accommodating recess 41 is formed at an intermediate portion of the rear surface of the slider 40 as shown in FIGS. 1 to 3 for accommodating a front end of the compression coil spring S. The spring accommodating recess 41 has a substantially round cross section that substantially conforms with the outer circumferential surface of the compression coil spring S and a spring inserting projection 41*a* is provided on the rear surface, as shown in FIG. 3, for insertion into the front end of the compression coil spring S. Further, an escaping recess 42 opens backward in the ceiling surface of the spring accommodating recess 41 for receiving the covering wall 30. The compression coil spring S is compressed resiliently between the rear surface of the spring accommodating recess 41 of the slider 40 and the front surface of the rear wall 29 of the female housing 20 as the slider 40 is moved back (see FIG. 14). A forwardly open deformation permitting recess 43 is formed substantially in the widthwise middle of the front end of the slider 40 for permitting the lock arm 65 to deform resiliently and move onto the lock 27. A part of the slider 40 behind the deformation permitting recess 43 is above the lock arm 65 when the housings 20, 60 are connected and prevents the resilient deformation of the lock arm 65 (see FIG. 15).

As shown in FIGS. 1 and 2, two front-stops 44 project from the bottom ends of the opposite side surfaces of the slider 40 and are engageable with the receiving portions 32 of the female housing 20. The front surface of the slider 40 is substantially flush with the front end of the female housing 20 at an initial position (see FIG. 5). At this initial position, the covering wall 30 is in the escaping recess 42 (see FIG. 11). The slider 40 can be moved back from this initial position to a retracted position where the rear end surface of the slider 40 is substantially flush with the rear end surface of the female housing 20 (see FIG. 21). At this retracted deformation permitting position, the deformation permitting recess 43 is above the front end of the lock arm 65, thereby permitting the resilient deformation of the lock arm 65. Insertion grooves 45 open forward, backward and outward at intermediate portions of the opposite outer side surfaces of the slider 40 with respect to the height direction to receive the respective supports 33 of the female housing 20. As shown in FIGS. 2 and 3, an arm 46 is cantilevered at the rear end of the slider 40 and is thinner than the front side. The lower surface of the arm 46 is substantially at the same height as the ceiling surfaces of the insertion grooves 45 and can be supported from below by the upper surfaces of the supports 33. The upper surface of the arm 46 is substantially at the same height as the lower surfaces of the restricting portions 35. Thus, the restricting portions 35 supports the arm 46 from above. The slider operating portion 47 projects up in an intermediate portion of the upper surface of the arm 46 and enables the slider 40 to be pulled backward.

Figure 7:
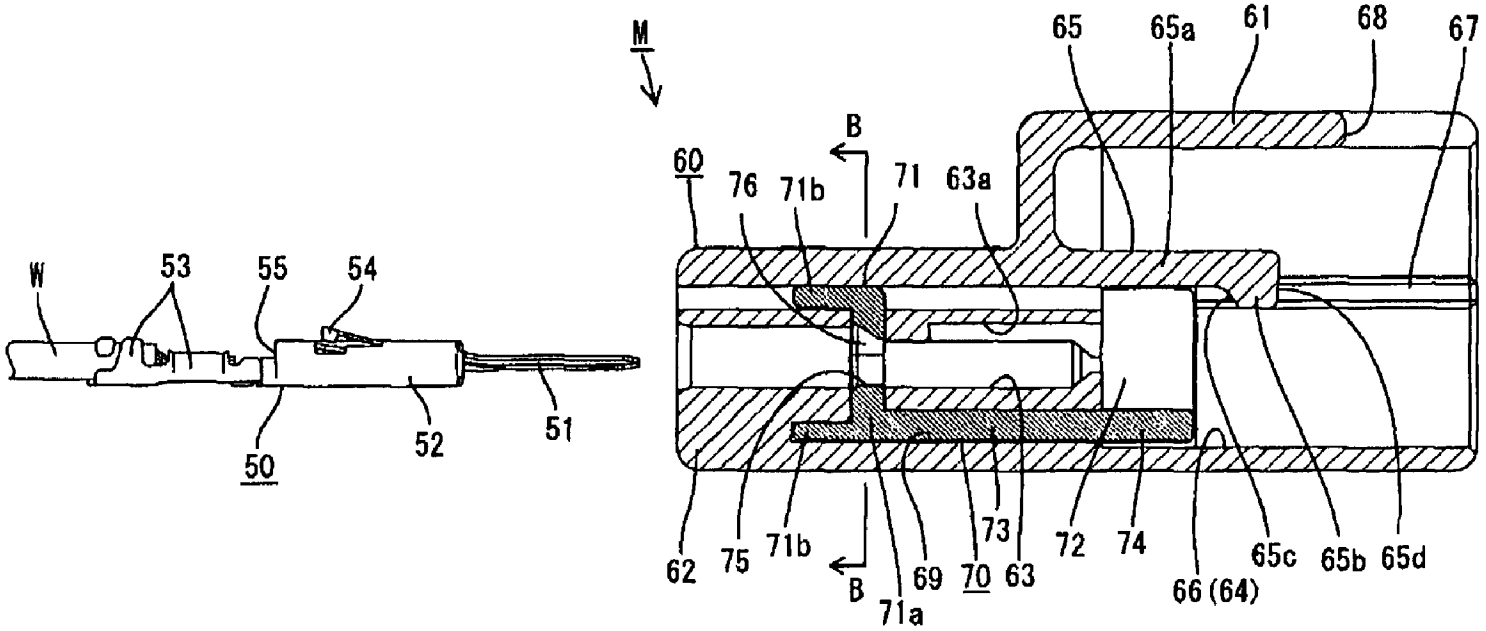
FIG. 7 is a section along 7—7 of FIG. 6.
Figure 8:
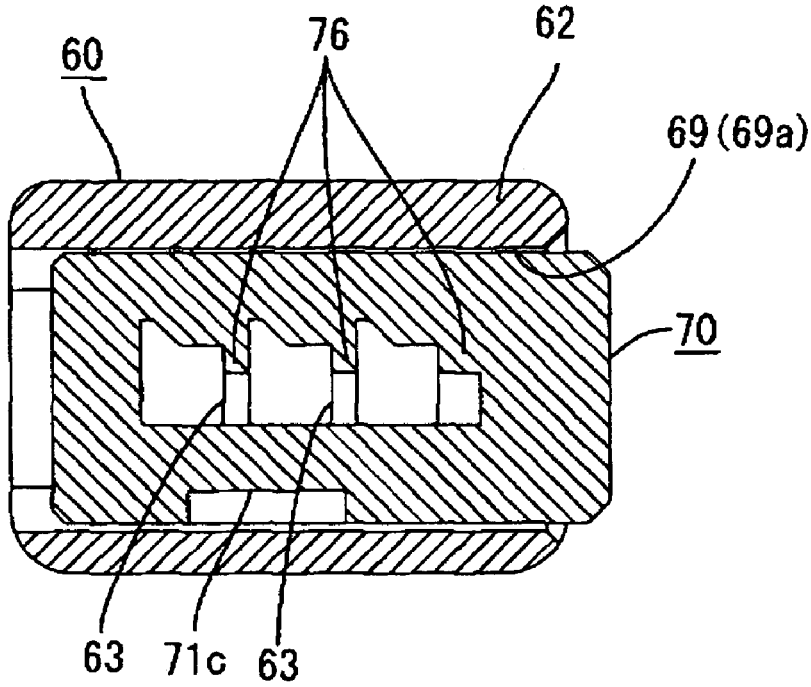
FIG. 8 is a section along 8—8 of FIG. 7.

Each male terminal fitting 50 of the male connector M has a tab 51, a substantially box-shaped main portion 52 and a barrel 53 coupled one after another in this order from the front, as shown in FIG. 7. The tab 51 is narrow and long along forward and backward directions and is electrically connectable with the female terminal fitting 10. A cut is made in the upper surface of the main portion 52 and the cut portion is bent to form a cantilevered lock 54 that is resiliently deformable along a vertical direction. The barrel 53 is configured to be crimped, bent or folded into connection with an end of a wire W.

Figure 6:
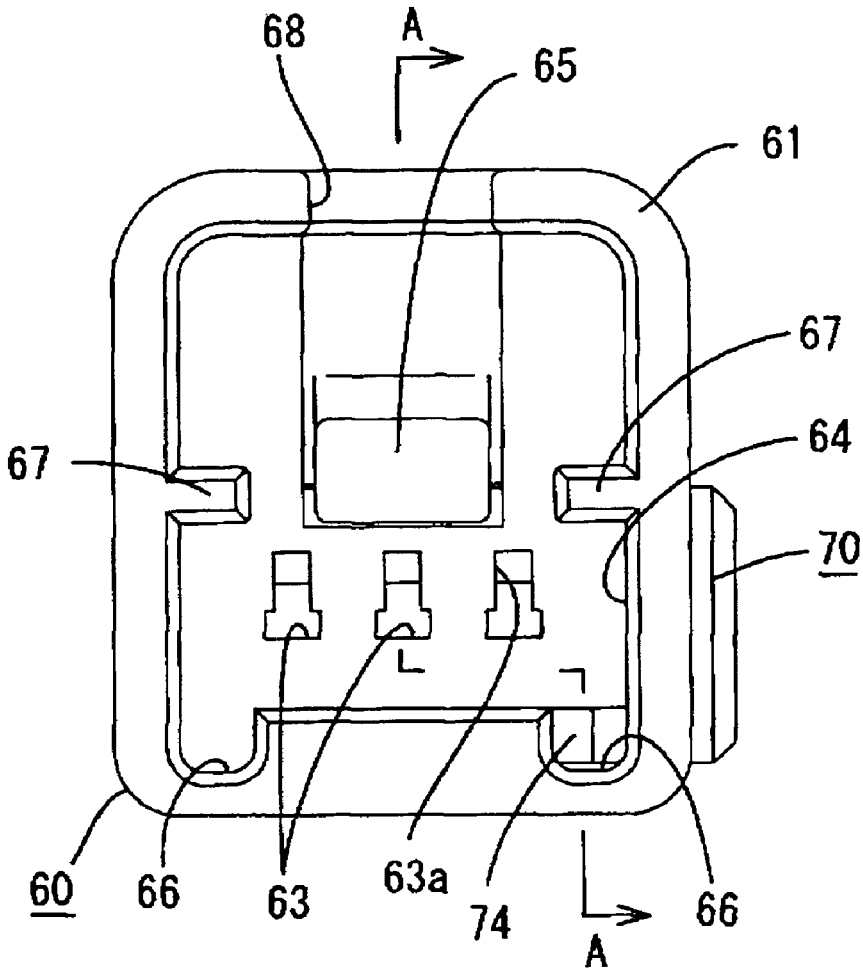
FIG. 6 is a front view of a male housing having a retainer mounted at a partial locking position.

The male housing 60 is made e.g. of a synthetic resin and has a receptacle 61 and a terminal accommodating portion 62 coupled one after the other as shown in FIGS. 6 and 7. The receptacle 61 is configured to receive the female housing 20. Three side-by-side cavities 63 are formed in the terminal accommodating portion 62 and the male terminal fittings 50 are insertable into the cavities 63 from behind. A forwardly open lock insertion groove 63*a* is formed in the ceiling surface of each cavity 63 and the lock 54 is engageable with the rear surface of the insertion groove 63*a*. On the other hand, the receptacle 61 is a substantially rectangular tube with an open front end, and is shorter than the female housing 20 by about the length of the restricting portions 35. A space inside the receptacle 61 into which the female housing 20 defines a fitting space 64.

A lock arm 65 projects forward at an intermediate position of the back surface of the receptacle 61 above the cavities 63. The lock arm 65 has an arm 65*a* that extends substantially along the connecting and separating directions CSD and a hook 65*b* projects down from a free front end of the arm 65*a* in a direction intersecting the connecting and separating directions CSD. The arm 65*a* is resiliently deformable in directions intersecting the connecting and separating directions CSD from a substantially horizontally extending natural state with a base end as a supporting point (see FIG. 13). A rear surface 65*c* of hook 65*b* can engage the rear surface 27*a* of the lock 27 on the female housing 20 to hold the housings 20, 60 connected (see FIG. 15). The rear surface 65*c* of the hook 65*b* is substantially arcuate or pointed and slopes down towards the front and substantially conforms to the shape of the rear surface 27*a* of the lock 27. Accordingly, the lock arm 65 is guided by the rear surfaces 27*a*, 65*c* and is deformed resiliently to disengage automatically from the lock 27 if a force of a specified intensity or higher acts to separate the housings 20, 60. Thus, the lock arm 65 and the lock 27 define a semi-locking construction. A front surface 65*d* of the lock arm 65 slopes up towards the front, and this inclination with respect to the connecting and separating direction CSD is steeper than the inclination of the rear surface 65*c* of the hook 65*b*.

Two rib insertion grooves 66 are provided at opposite ends of the inner bottom surface of the receptacle 61 for receiving the ribs 24 of the female housing 20. The rib insertion grooves 66 are formed over substantially the entire length of the receptacle 61. Spaces in the rib insertion grooves 66 form a part of the fitting space 64. The bottom wall of the receptacle 61 is relatively thick between the rib insertion grooves 66 and relatively thin at portions where the rib insertion grooves 66 are formed. Ribs 67 project in from the opposite inner side surfaces of the receptacle 61 substantially at the same height as the lock arm 65 and are insertable into the rib insertion grooves 25 of the female housing 20. An escaping recess 68 is formed in the widthwise middle of the upper wall of the receptacle 61 for receiving the slider-operating portion 47 of the slider 40. The width of the escaping portion 68 is substantially equal to or slightly larger than the width of the slider-operating portion 47.

Figure 16:
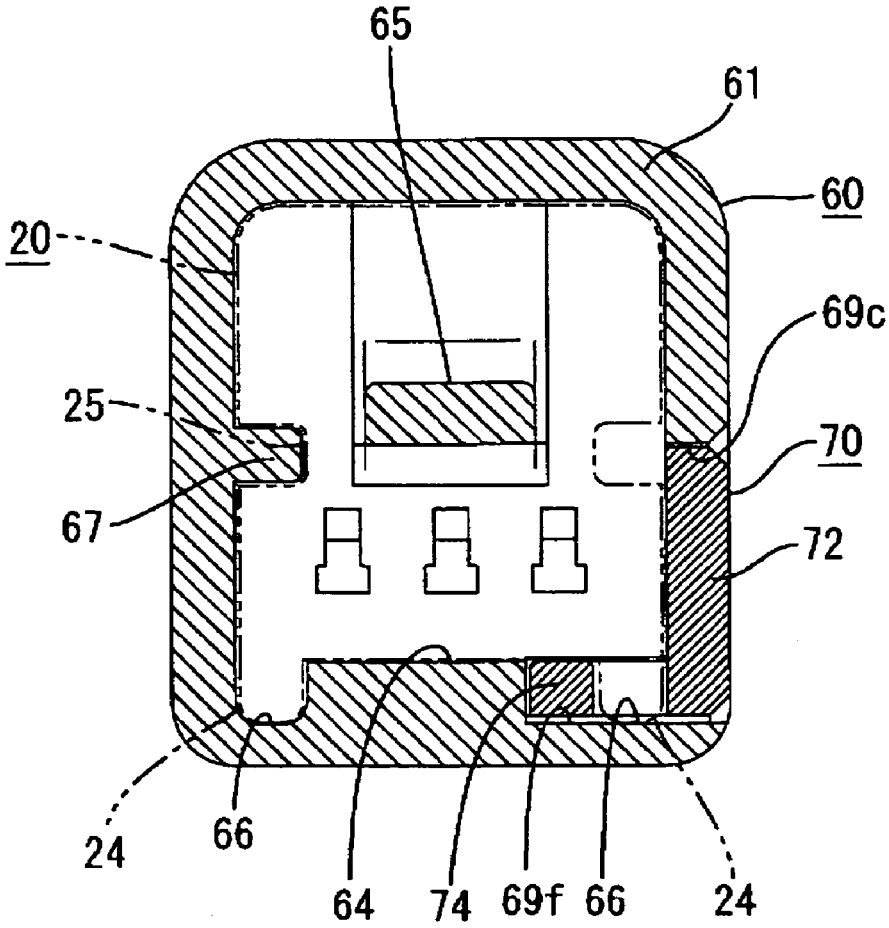
FIG. 16 is a section along 16—16 of FIG. 15 showing the male housing and the retainer.
Figure 17:
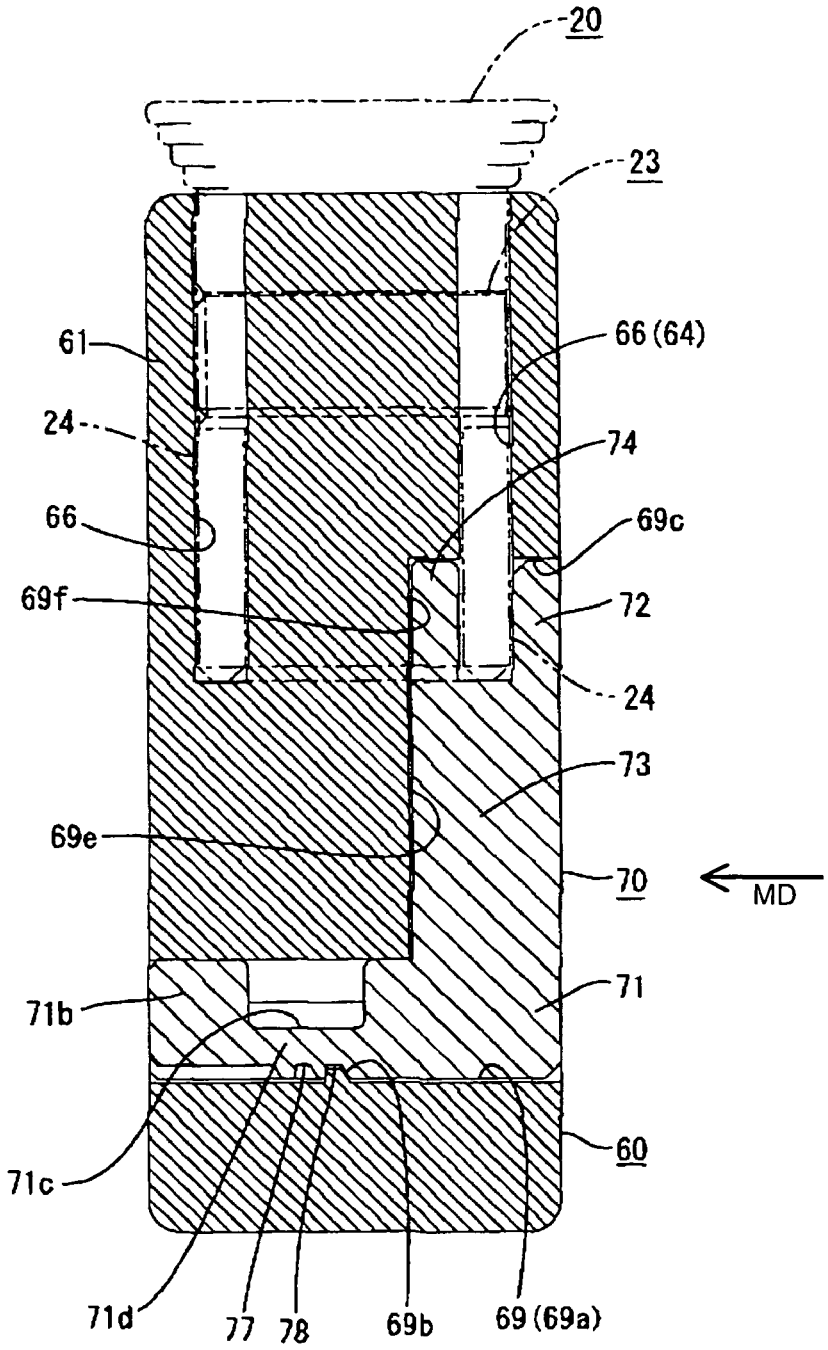
FIG. 17 is a section along 17—17 of FIG. 15 showing the male housing and the retainer.
Figure 18:
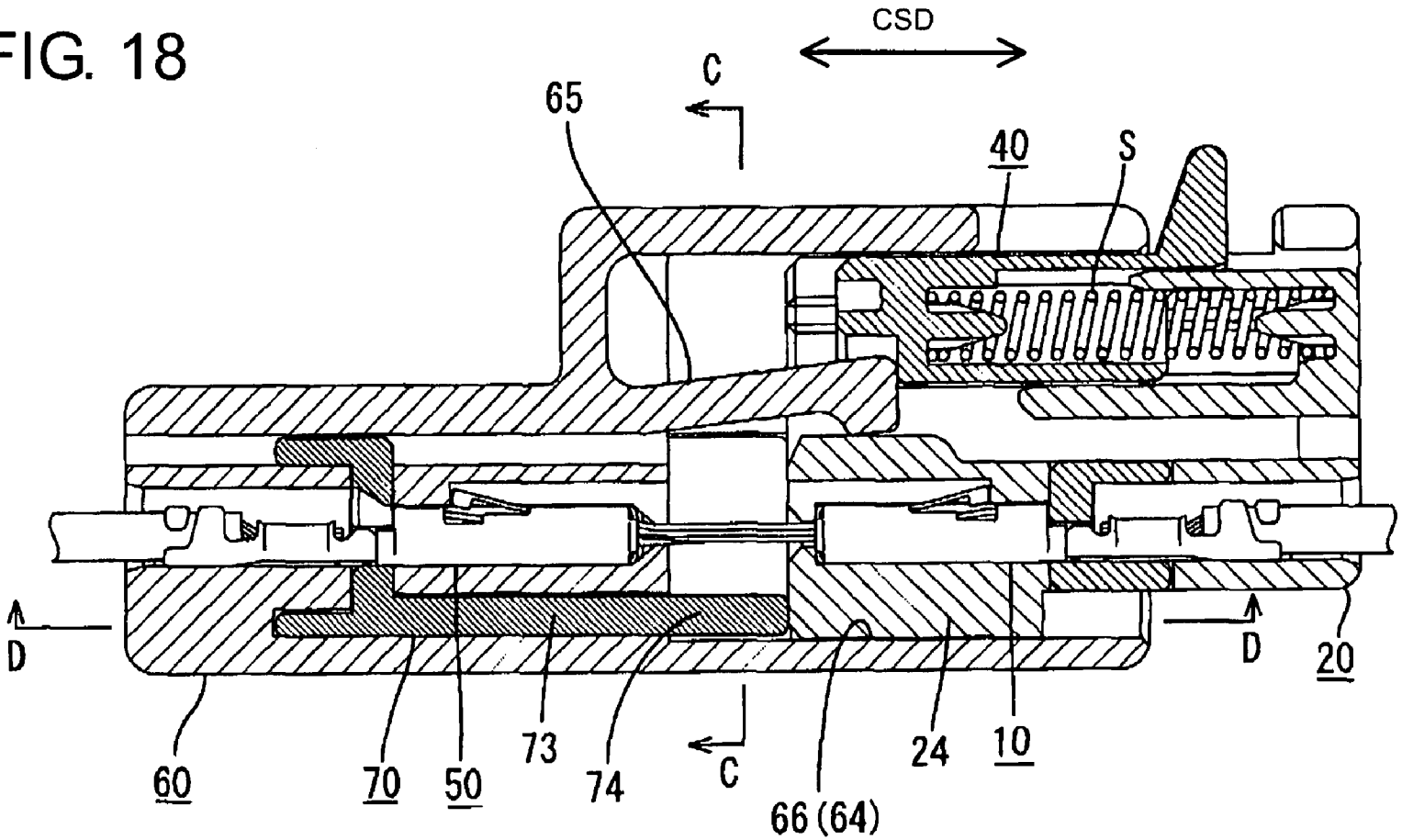
FIG. 18 is a section similar to FIG. 11, but showing a state where a connecting operation of the female housing with the male housing having the retainer mounted at the partial locking position is hindered.

A retainer mount hole 69 penetrates the side surfaces of the male housing 60 in a widthwise direction and intersects the cavities 63. The retainer mount hole 69 conforms with the outer shape of the retainer 70 so that the retainer 70 can be accommodated therein. More specifically, the retainer mount hole 69 has a U-shaped main-portion accommodating portion 69*a* that opens in the left surface of the male housing 60, as shown in FIG. 9(A). The main-portion accommodating portion 69*a* conforms with the outer shape of the main portion 71. The retainer mount hole 69 has a holding portion 69*b* that projects from the rear edge of a section of the main-portion accommodating portion 69*a* for accommodating a lower horizontal plate 71*b*, as shown in FIG. 17. The holding portion 69*b* is engageable with the retainer 70 to hold the retainer 70 at a specified position. The retainer mount hole 69 has a side-plate accommodating portion 69*c* that opens in the right surface of the male housing 60, as shown in FIG. 9(B), for accommodating a side plate 72 of the retainer 70. The side-plate accommodating portion 69*c* extends from the terminal accommodating portion 62 to the receptacle 61 of the male housing 60 and has a substantially rectangular side view that conforms to the outer shape of the side plate 72. A jig insertion recess 69*d* is formed at the rear opening edge of the side-plate accommodating portion 69*c* for receiving a jig for detaching the retainer 70. A rear end of the right rib 67 of FIG. 6 is cut away over a specified length (see FIG. 16) due to the presence of the side-plate accommodating portion 69*c*. A coupling-portion accommodating portion 69*e* of the retainer mount hole 69 and a detector accommodating portion 69*f* are formed by cutting a left side of the outer periphery of the right rib insertion groove 66 as shown in FIG. 17. The coupling-portion accommodating portion 69*e* of the retainer mount hole 69 accommodates a coupling portion 73 of the retainer 70, and the detector accommodating portion 69*f* accommodates a detector 74 of the retainer 70. The coupling-portion accommodating portion 69*e* and the detector accommodating portion 69*f* are exposed rightward to the outside through the side-plate accommodating portion 69*c*.

Figure 10:
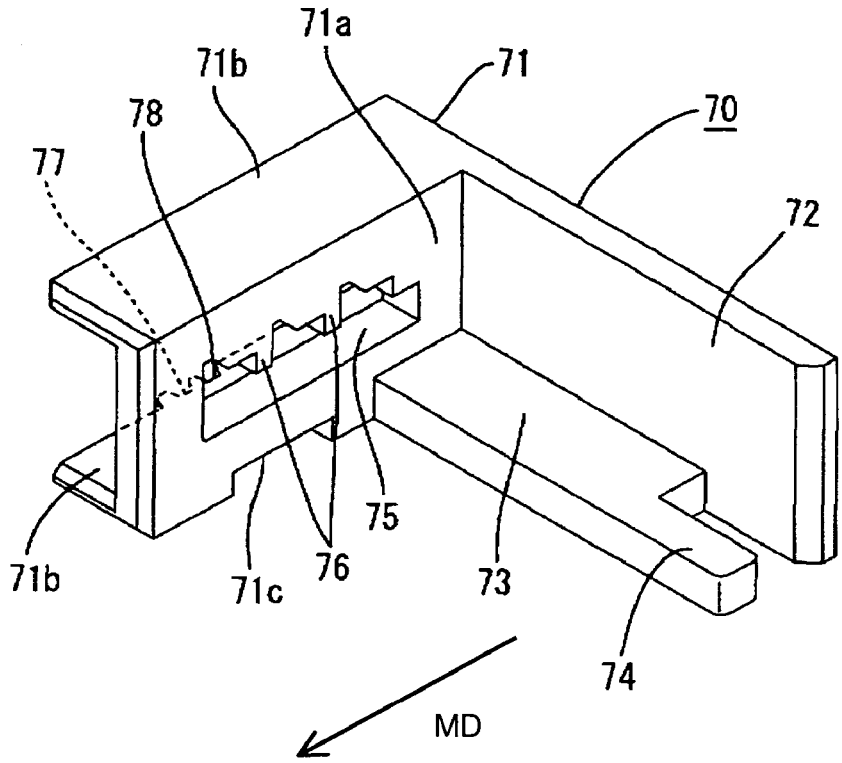
FIG. 10 is a perspective view of the retainer.

The retainer 70 is made e.g. of a synthetic resin and has the main portion 71 with a substantially U-shaped side view. A side plate 72 extends forward from the right end of the main portion 71 and has a substantially rectangular side view. A coupling portion 73 is coupled to the bottom edge of the front surface of the main portion 71 and the bottom edge of the inner surface of the side plate 72, and the detector 74 projects forward substantially normal to the mounting direction MD from the coupling portion 73, as shown in FIG. 10. The main portion 71 includes a substantially vertical plate 71*a* with plate surfaces that face forward and backward. Two substantially horizontal plates 71*b* extend back from the upper and bottom ends of the vertical plate 71*a* and face each other. Terminal introducing holes 75 penetrate the vertical plate 71*a* and communicate with the respective cavities 63 for permitting the insertion of the respective male terminal fittings 50. A fastening portion 76 projects down from the upper edge of each terminal introducing hole 75 in a direction intersecting the mounting direction MD and is engageable with a jaw 55 of the main portion 52 of the male terminal fitting 50. Three fastening portions 76 are arranged substantially side by side along the mounting direction MD at substantially the same intervals as the respective cavities 63. The retainer 70 is movable widthwise along the mounting direction MD between a partial locking position and a full locking position. The terminal introducing holes 75 communicate with the corresponding cavities 63 and the respective fastening portions 76 are retracted sideways from the cavities 63 when the retainer is in the partial locking position (see FIGS. 7 and 8). The fastening portions 76 are in the cavities 63 and engage the male terminal fittings 50 (see FIGS. 11 and 12) when the retainer 70 is in the full locking position.

Figure 20:
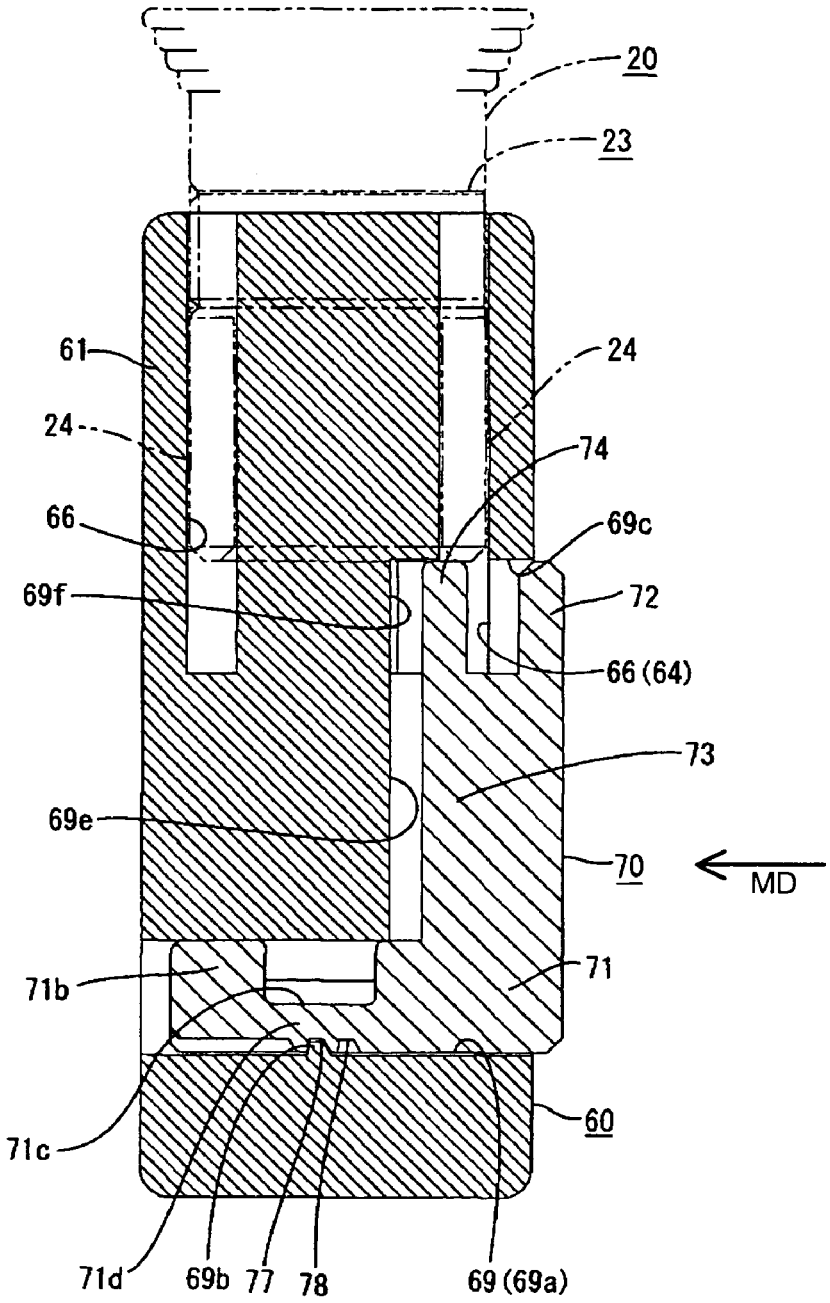
FIG. 20 is a section along 20—20 of FIG. 18 showing the male housing and the retainer.
Figure 21:
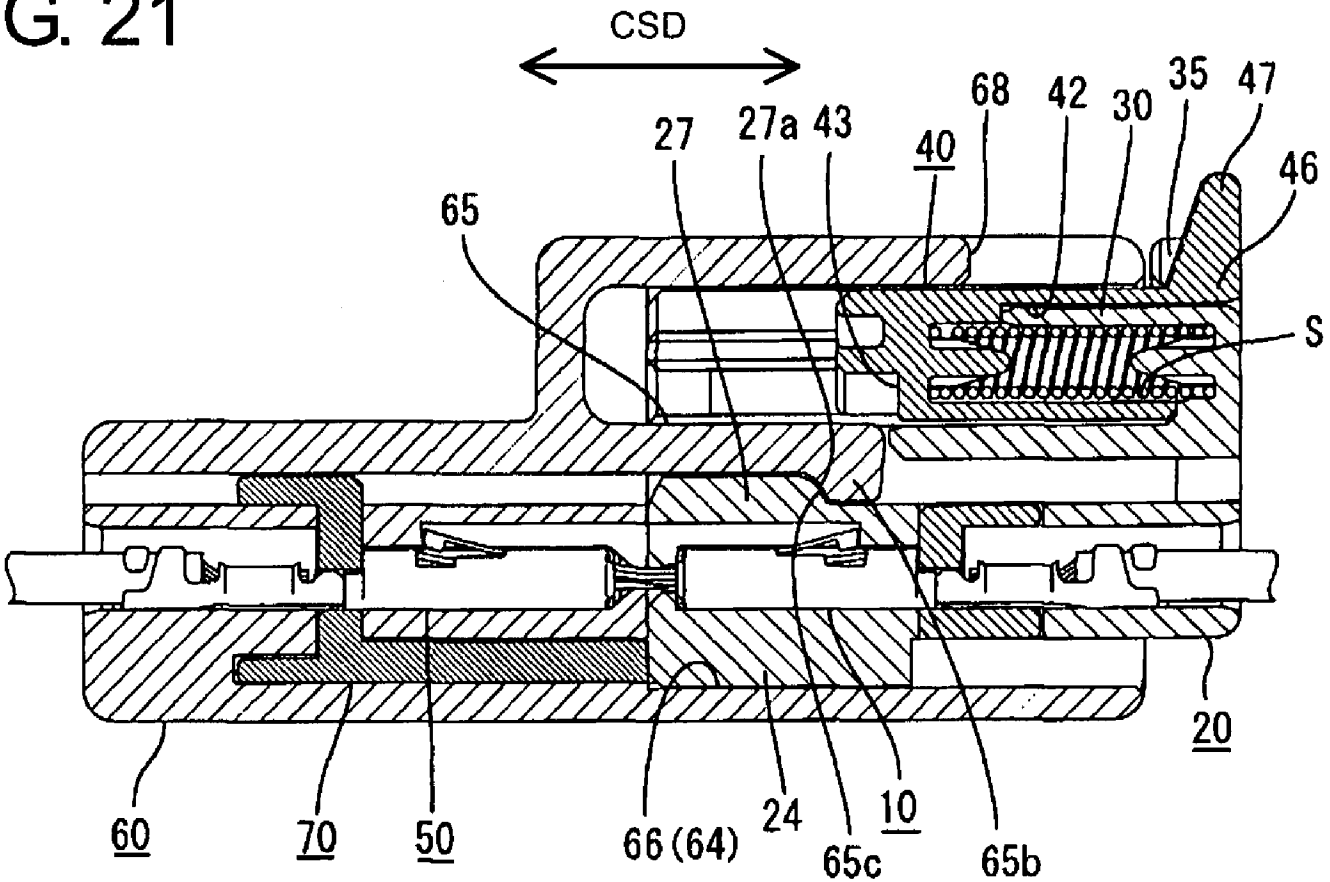
FIG. 21 is a section similar to FIG. 11, but showing the slider moved back to a deformation permitting position at the time of separation.
Figure 22:
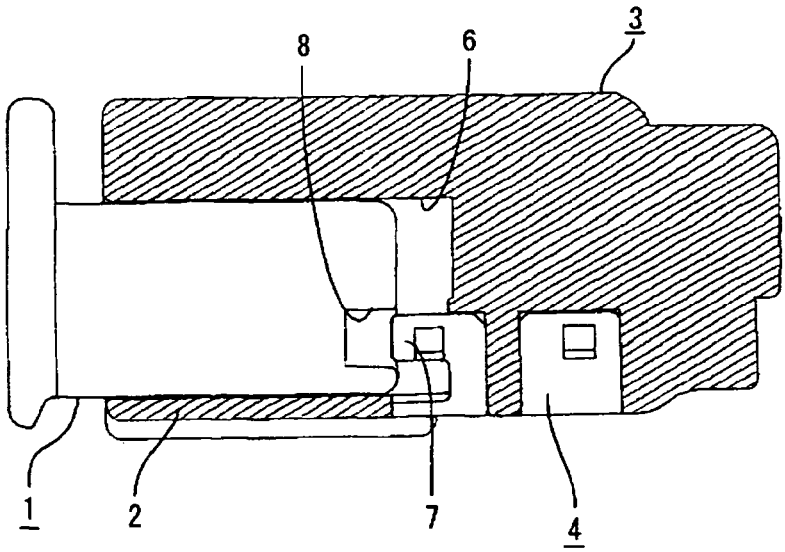
FIG. 22 PRIOR ART
FIG. 22 is a section of a prior art connector.

Holding grooves 77 and 78 are formed side by side or substantially along the mounting direction MD at the rear edge of the lower horizontal plate 71*b* of the main portion 71 and are engageable with the holding portion 69*b* of the retainer mount hole 69. The holding portion 69*b* engages the holding groove 77 to hold the retainer 70 at the partial locking position as shown in FIG. 20. At this partial locking position, the side plate 72 projects sideways from the outer side surface of the male housing 60 and the retainer 70 is more rightward than when at the full locking position. On the other hand, the holding portion 69*b* engages the holding groove 78 to hold the retainer 70 at the full locking position as shown in FIG. 17. At this full locking position, the outer surface of the side plate 72 is substantially flush with the outer side surface of the male housing 60. Further, the lower horizontal plate 71*b* has a cut-out 71*c* in an area wider than an area between the two holding grooves 77 and 78 to form an arm 71*b* supported at both ends. The arm 71*b* is resiliently deformable when the retainer 70 is operated with an operation force of a specified intensity or higher. This makes it easier for the holding portion 69*b* to enter and exit from the respective holding grooves 77, 78 when the retainer 70 is moved.

Figure 19:
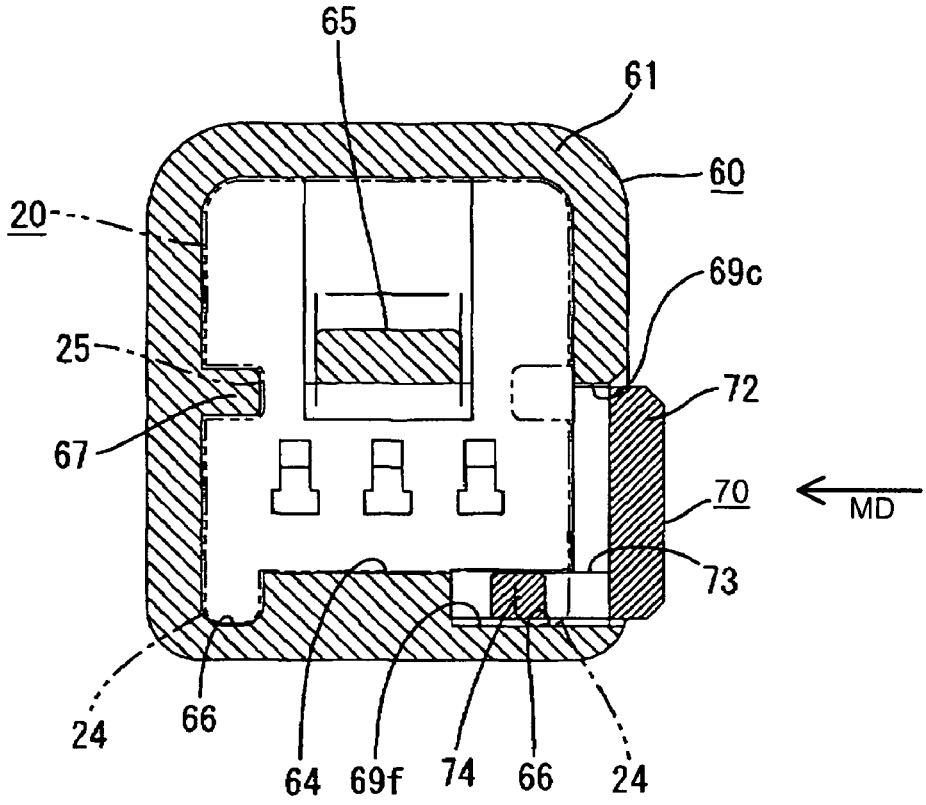
FIG. 19 is a section along 19—19 of FIG. 18 showing the male housing and the retainer.

As shown in FIG. 10, the coupling portion 73 has a length slightly shorter than the side plate 72 and preferably by about the length of the detector 74. The detector 74 is located at the left end of the front edge of the coupling portion 73 in FIG. 10 and substantially opposed to the side plate 71 at a specified spacing (preferably about the width of the ribs 24 of the female housing 20), and the front end position thereof is substantially aligned with that of the side plate 72. Further, the detector 74 is more toward the side plate 72 than the widthwise middle of the retainer 70. The detector 74 is in the receptacle 61, as shown in FIG. 7, when the retainer 70 is mounted in the retainer mount hole 69. The detector 74 is in the rib insertion groove 66, i.e. the fitting space 64, when the retainer 70 is at the partial locking position, as shown in FIGS. 19 and 20. Accordingly, the rib 24 of the female housing 20 contacts the front end of the detector 74 if an attempt is made to connect the two housings 20, 60 in this state, thereby preventing any further connecting operation. On the other hand, the detector 74 is accommodated in the detector accommodating portion 69*f* of the retainer mount hole 69 and is retracted laterally (leftward) from the rib insertion groove 66 as shown in FIGS. 16 and 17 when the retainer 70 is at the full locking position. Accordingly, the detector does not interfere with the rib 24 if an attempt is made to connect the two housings 20, 60 in this state. Thus, the rib 24 enters the rib insertion groove 66, and the connecting operation is permitted.

Figure 4:
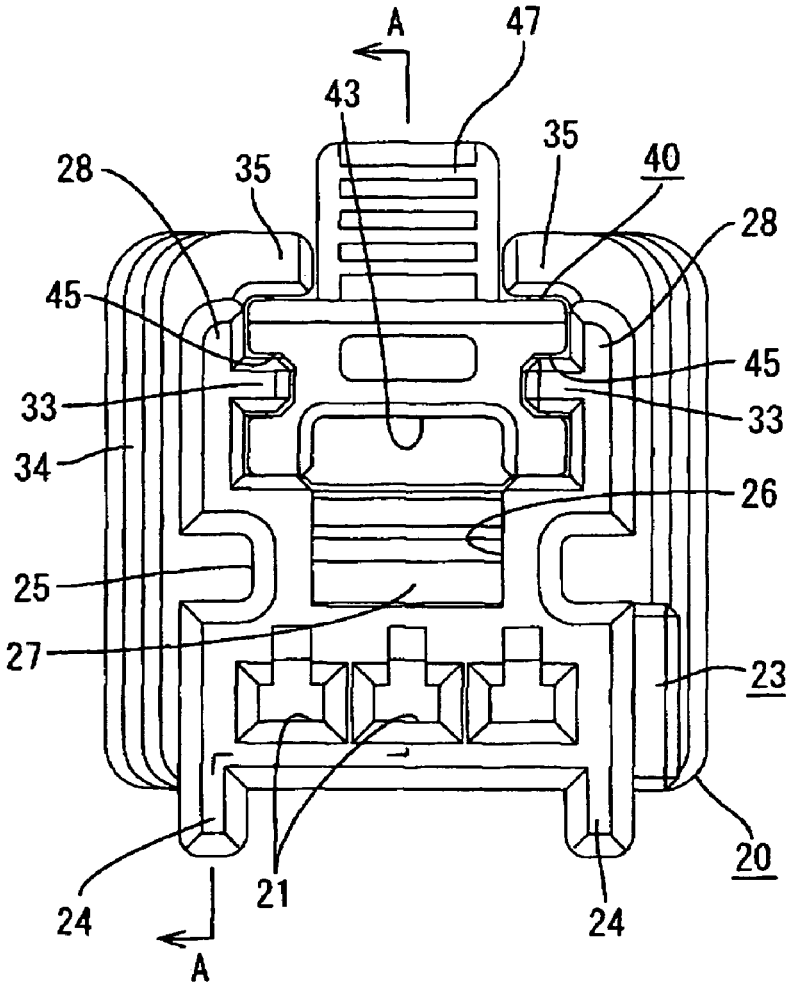
FIG. 4 is a front view of the female housing having the slider mounted therein.
Figure 5:
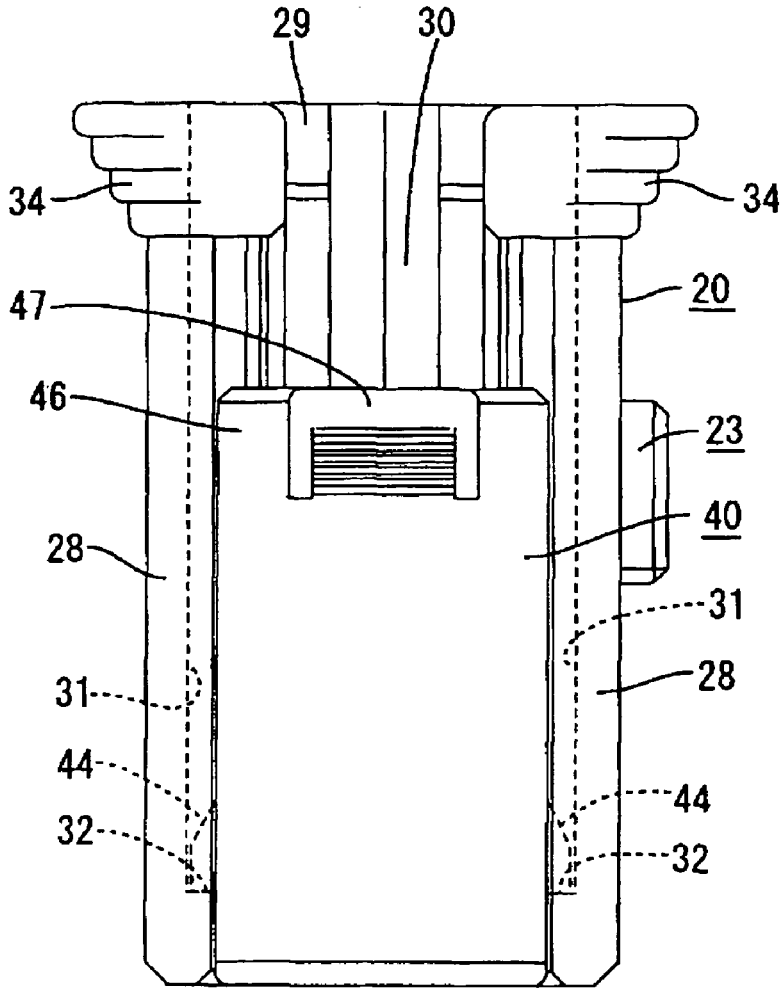
FIG. 5 is a plan view of the female housing having the slider therein.
Figure 11:
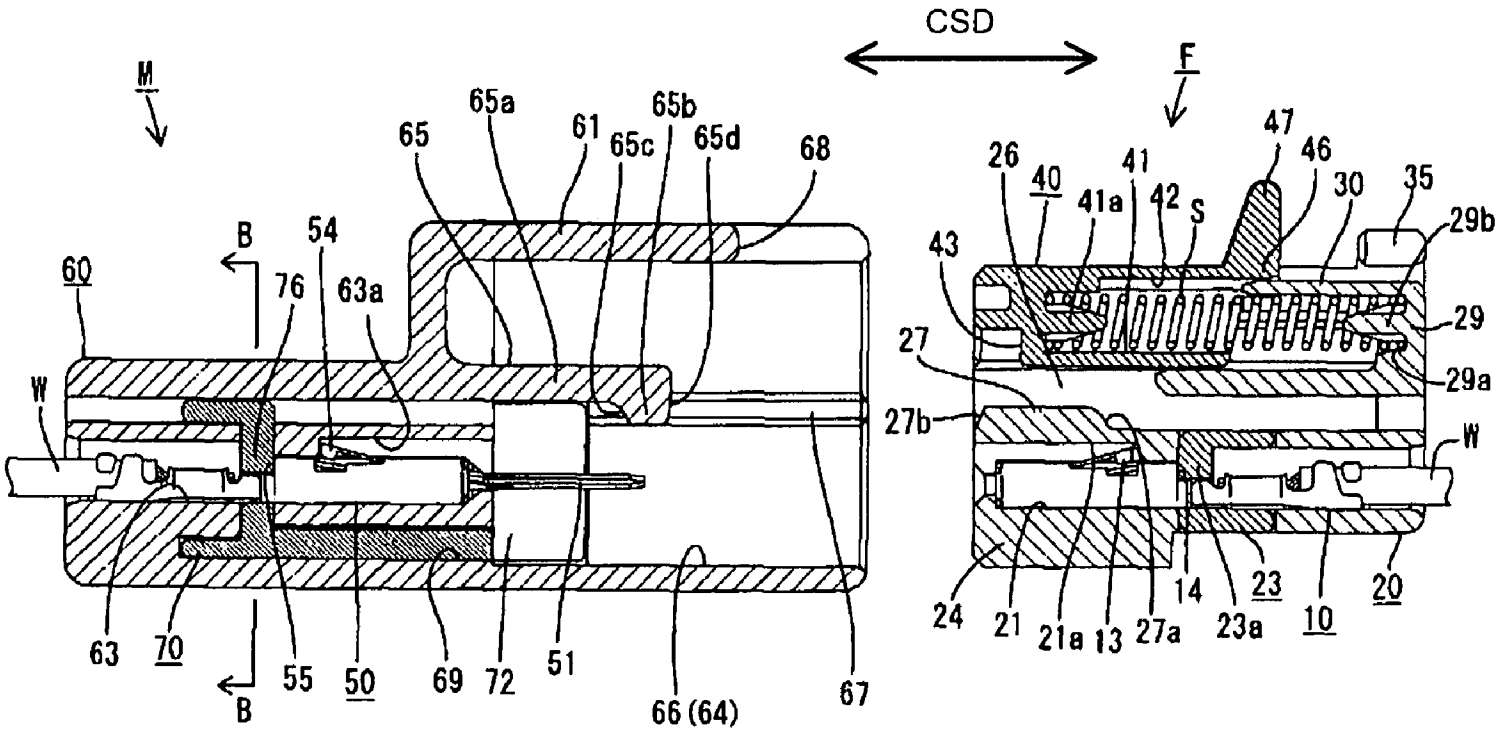
FIG. 11 is a section along 4—4 of FIG. 4 and 6—6 of FIG. 6 showing a state before both housings are connected with both retainers mounted at their partial locking positions.
Figure 12:
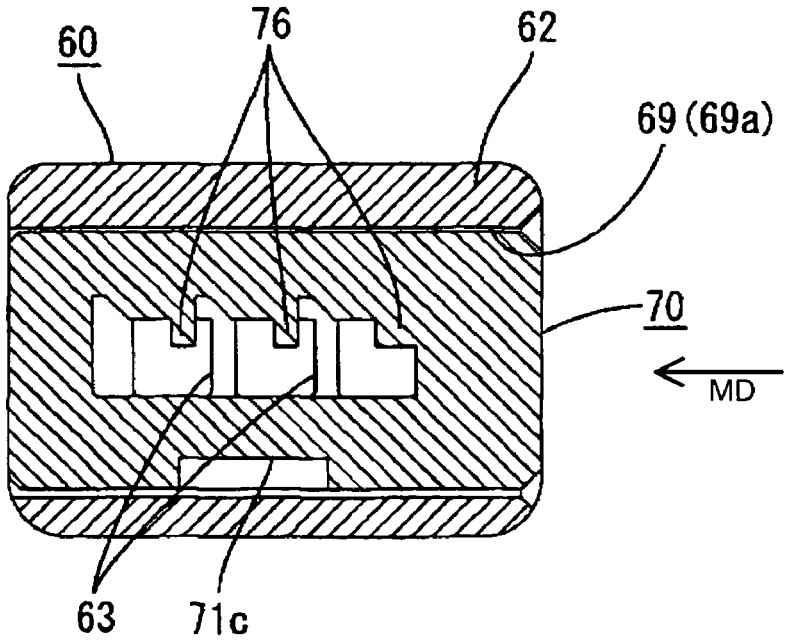
FIG. 12 is a section along 12—12 of FIG. 11.

The female connector F is assembled by mounting the compression coil spring S and the slider 40 into the female housing 20 and holding the slider 40 at the initial position so as not to move any further forward. Additionally, the retainer 23 is mounted at the partial locking position, as shown in FIGS. 4 and 5. The female terminal fittings 10 then are inserted into the corresponding cavities 21 and are locked partly by the locks 13. Thereafter, the retainer 23 is pushed to the full locking position so that the fastening portions 23*a* engage the jaws 14 to fully or doubly lock the female terminal fittings 10, as shown in FIG. 11. On the other hand, the male connector M is assembled by inserting the male terminal fittings 50 into the corresponding cavities 63 in the male housing 60 while the retainer 70 is at the partial locking position, as shown in FIGS. 6 to 7. Thus, the locks 54 lock the male terminal fittings 50. The retainer 70 then is pushed to the full locking position so that the fastening portions 76 engage the jaws 55 to fully or doubly lock the male terminal fittings 50, as shown in FIGS. 11 and 12.

The female housing 20 then is fit into the fitting space 64 of the receptacle 61 of the male housing 60 in the state shown in FIG. 11. As a result, the ribs 24, 67 enter the corresponding rib insertion grooves 25, 66. The connecting operation is guided smoothly by the sliding contact of the circumferential surfaces of the ribs 24, 67 and the grooves 25, 66. At this time, the detector 74 of the retainer 70 in the male connector M is in the detector accommodating portion 69*f* and is retracted sideways from the rib insertion groove 66 in the fitting space 64 to avoid interference with the rib 24. Thus, the connecting operation is not hindered (see FIGS. 16 and 17). When the two connectors F, M are connected to a specified depth, the lock arm 65 is guided by the inclinations of its front surface 65*d* and/or the front surface 27*b* of the lock 27 and resiliently deformed while moving onto the lock 27. An attempt could be made to connect the two connectors F, M while the female housing 20 is oriented incorrectly (e.g. vertically inverted) with respect to the male housing 60. However, the respective ribs 24, 67 will not align with the corresponding rib insertion grooves 25, 66, thereby preventing connection.

Figure 13:
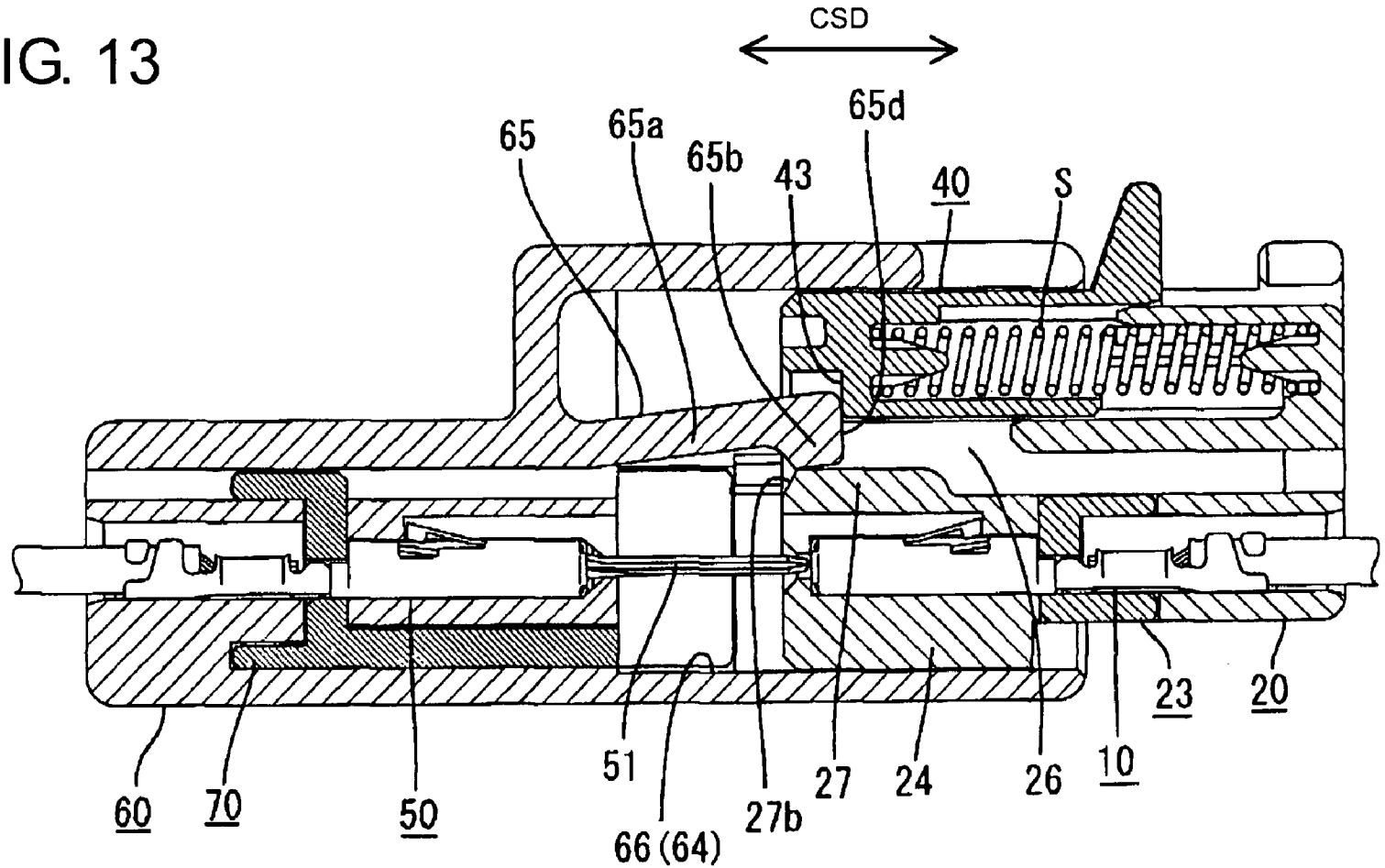
FIG. 13 is a section similar to FIG. 11, but showing an initial stage of connection.
Figure 14:
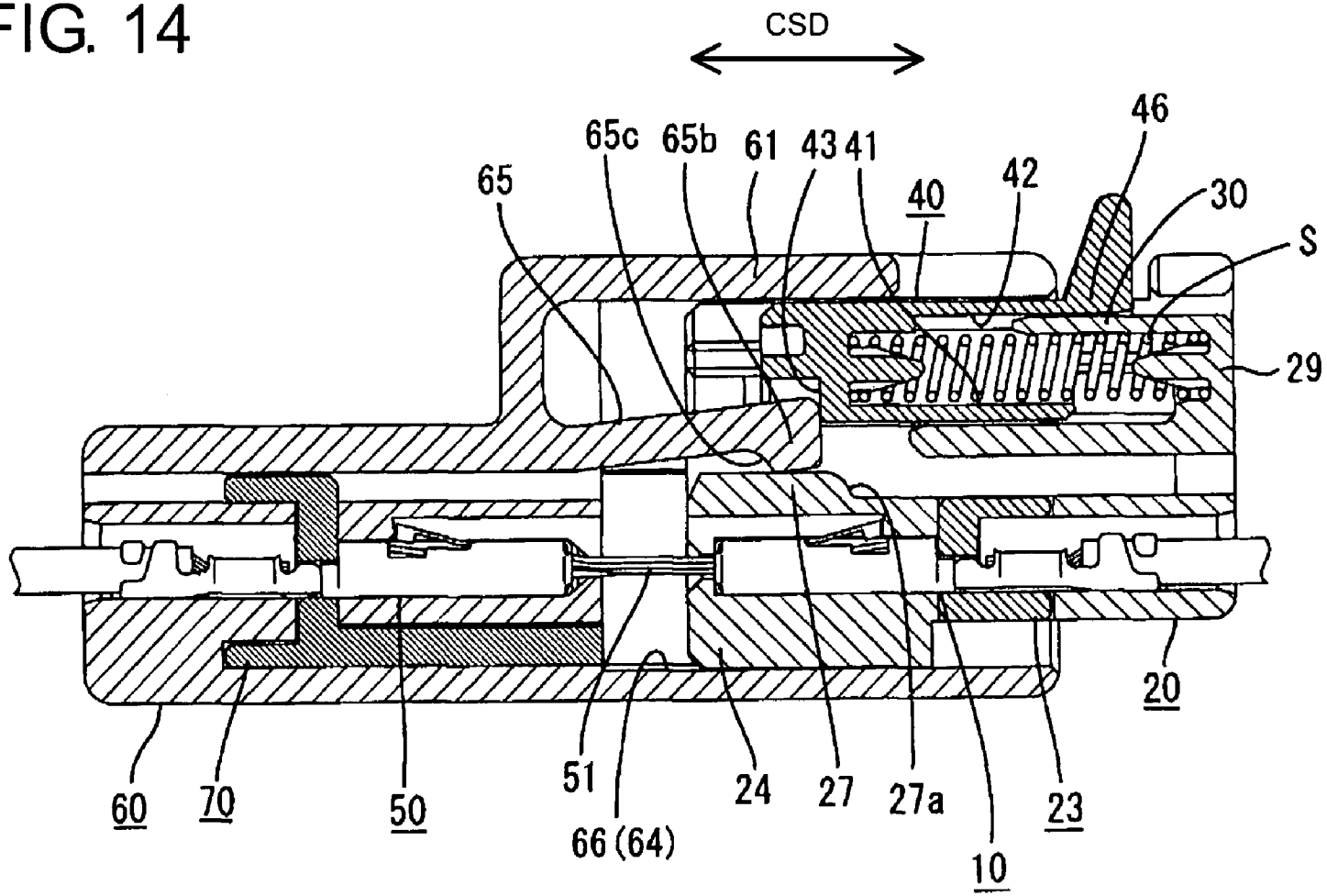
FIG. 14 is a section similar to FIG. 11, but showing an intermediate stage of connection.

The inclined lock arm 65 escapes into the deformation permitting recess 43 of the slider 40 and the front surface 65*d* thereof contacts the front surface of the deformation permitting recess 43, as shown in FIG. 13. At this stage, the terminal fittings 10, 50 are not yet in contact with each other. The lock arm 65 pushes the slider 40 back as the connecting operation proceeds further and the compression coil spring S is compressed resiliently, as shown in FIG. 14. This backward movement of the slider 40 is guided without vertically shaking by the sliding contact of the circumferential surfaces of the supports 33 and the insertion grooves 45, the sliding contact of the supports 33 and the covering wall 30 with the arms 46 from below, and the sliding contact of the restricting portions 35 with the arms 46 from above.

The connecting operation may be interrupted, for example, if an operator mistakenly believes that a proper connection has been reached. In such a case, a biasing force accumulated thus far in the compressed coil spring S is released and the forwardly biased slider 40 pushes the lock arm 65. Thus, the two housings 20, 60 are separated from each other. In this way, a situation where the two housings 20, 60 are left partly connected can be avoided (so-called go/no-go connector).

Figure 15:
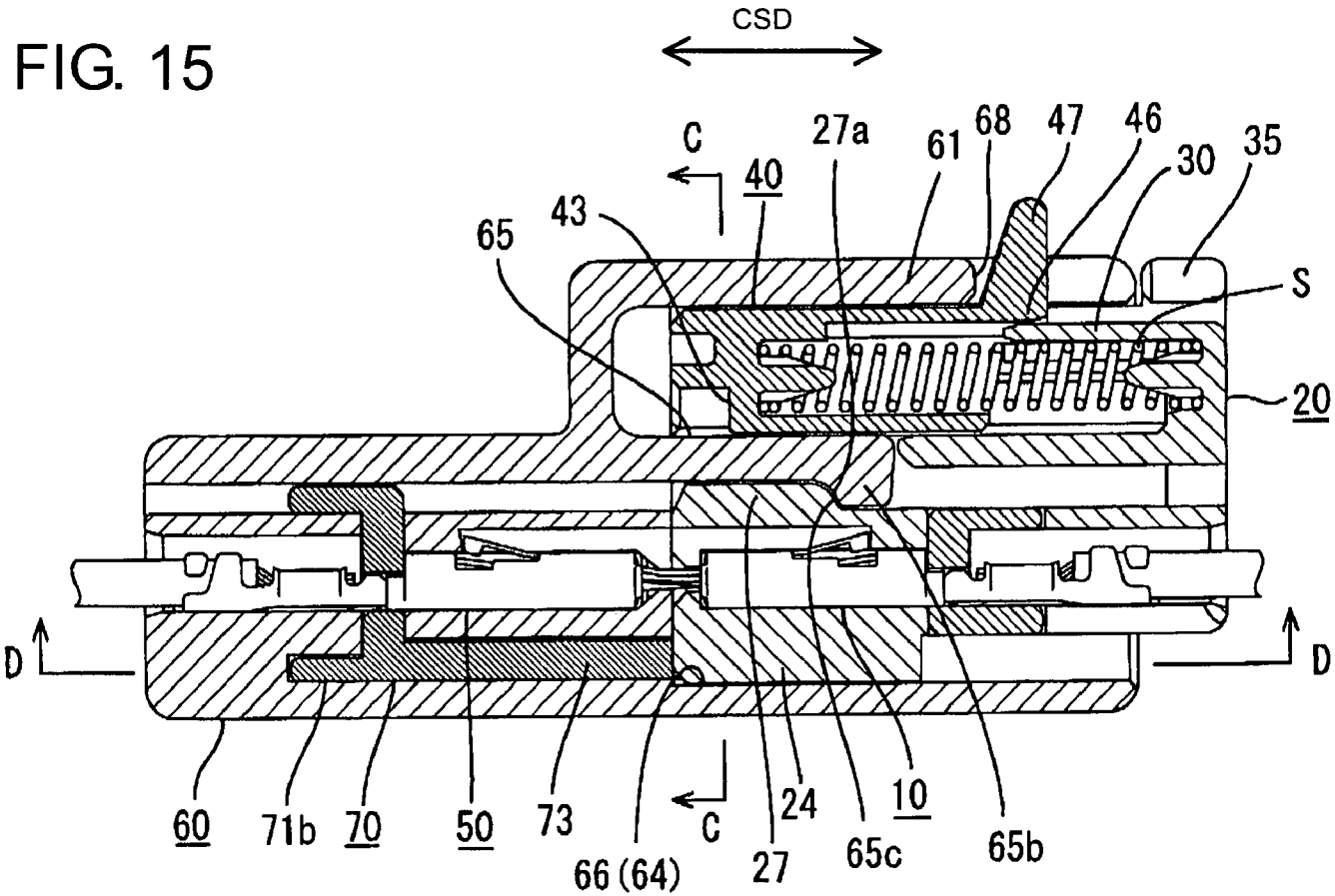
FIG. 15 is a section similar to FIG. 11, but showing a properly connected state.

The hook 65*b* moves over the lock 27 and the lock arm 65 is restored substantially to its unbiased horizontal posture (natural state) to escape into the escaping portion 26, as shown in FIG. 15, when the housings 20, 60 are connected to a proper depth. At this time, the rear surface 65*c* of the hook 65*b* engages the rear surface 27*a* of the lock 27. The slider 40 is freed from the pushed state by the lock arm 65 and moves forward because the biasing force accumulated in the compression coil spring S is released. The slider 40 is stopped at the initial position (see FIG. 5) by the contact of the front-stops 44 with the receiving portions 32 and cannot move any farther forward. At this time, the slider 40 enters the deformation permitting space above the lock arm 65 and covers the lock arm 65 to prevent deformation of the lock arm 65. In this way, the housings 20, 60 are held connected so as not to separate from each other. During the forward movement of the slider 40, the slider-operating portion 47 is in the escaping recess 68 of the receptacle 61 and the front surface thereof reaches a position in proximity to the front surface of the escaping recess 68. In this connected state, the tabs 51 of the male terminal fittings 50 are connected electrically with the respective female terminal fittings 10. Further, in the connected state, the rear end of the female housing 20 projects forward from the receptacle 61 by a specified length, and the restricting portions 35 and the housing operating portions 34 are substantially opposed to the receptacle 61 while the restricting portions 35 leave almost no clearance to the receptacle 61 and the housing operating portions 34 preferably leave a specified clearance to the receptacle 61 (see FIG. 17).

At least one of the retainers 23, 70 may not have reached their full locking positions because the retainers 23, 70 were pushed insufficiently or an operation of pushing the retainers 23, 70 was forgotten. For example, if the retainer 23 is at a position before the full locking position in the female housing F, the retainer 23 projects sideways from the outer side surface of the female housing 20 (see FIG. 5). Thus, at the time of connecting the two connectors F, M, the projecting portion of the retainer 23 will contact the front edge of the receptacle 61, thereby preventing the connecting operation. In this way, the situation where the retainer 23 of the female connector F has not yet reached the full locking position can be detected.

The detector 74 is in the rib insertion groove 66 of the fitting space 64 and blocks the insertion path of the corresponding rib 24, as shown in FIGS. 19 and 20, if the retainer 70 has not reached the full locking position in the male connector M. An attempt may be made to connect the two connectors F, M in this state. However, the rib 24 will contact the front surface of the detector 74 upon being inserted to a specified depth in the rib insertion groove 66, thereby preventing the connection of the two housings 20, 60. In this way, whether the retainers 23, 70 have reached the full locking positions can be detected based on whether the connecting operation can be performed. The retainer 70 may be pushed slightly towards the full locking position from the partial locking position in the male connector M. However, the detector 74 is in the rib insertion groove 66 until the retainer 70 completely reaches the full locking position. Thus, the connecting operation is prevented even in such a case as well.

The two connectors F, M may have to be detached for maintenance or other reason after the connection was completed. In this situation, the slider operating portion 47 is pulled backward to move the slider 40 backward while resiliently compressing the compression coil spring S, and the housing operation portions 34 are held to pull the female housing 20 backward. The backward sliding movement of the slider 40 is guided as during the connecting operation. The slider 40 eventually is retracted completely from its position above the lock arm 65 and reaches the deformation permitting position shown in FIG. 21. The pulling forces exerted on the female housing 20 and the slider 40 in separating directions cause the lock arm 65 to be deformed automatically up and out due to its semi-locking construction. This deformation of the lock arm 65 is guided by the rear surface 65*c* of the hook 65*b* and the rear surface 27*a* of the lock 27. Further pulling of the female housing 20 in separating direction moves the hook 65*b* onto the lock 27 and cancels the locked state. Thus, the female housing 20 is pulled out in this state. The separating operation may be interrupted halfway. In such a case, the biasing force accumulated in the resiliently compressed compression coil springs S is released to move the slider 40 forward, and the slider 40 contacts the front surface 65*d* of the lock arm 65 inclined as a result of the resilient deformation. Therefore, the two housings 20, 60 are forcibly separated. In this way, the two housings 20, 60 are prevented from being left insufficiently connected at the time of separation.

As described above, the detector 74 is located outside the rib insertion groove 66 and hence outside the fitting space 64 when the retainer 70 is at the full locking position. Thus, unlike the prior art, it is not necessary to form the mating female housing with an escaping groove for receiving the detector. Therefore, the connector can be more suitably miniaturized since the escaping groove is not necessary and the construction can be simplified.

Further, the detector 74 is at the front side of the retainer 70 with respect to its mounting direction MD into the male housing 60 and is at a front side with respect to the connecting and separating direction CSD when the retainer 70 is mounted to the male housing 60. Thus, a formation area for the detector accommodating portion 69*f* for escaping the detecting portion 74 in the male housing 60 is small as compared to a case where the detector is at a back end of the retainer with respect to its mounting direction. Accordingly, a reduction in the strength of the male housing 60 can be suppressed upon providing the detector accommodating portion 69*f*. Further, the detector 74 is on the coupling portion 73 coupled to the side plate 72 and the main portion 71. Thus, the strength of the entire retainer 70 can be maintained to be high.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The position of the detector can be changed. Specifically, an embodiment in which the detector is arranged to retract from the fitting space by entering the detector accommodating portion formed in the rib or the receptacle of the male housing when the retainer reaches the full locking position also is embraced by the invention. An embodiment in which the detector interferes with a part of the female housing other than the rib as a result of a change in the position of the detector also is embraced by the invention. Further, an embodiment in which a female housing having no rib is connected also is embraced by the invention.

Instead of being moved along widthwise direction, the retainer may be moved, for example, along height direction. In other words, the retainer may be moved in any direction intersecting the connecting and separating direction CSD and/or the direction for fitting the terminal fittings into the housing.

Although each retainer is movable between the partial locking position and the full locking position in the foregoing embodiment, the partial locking position may be left out according to the invention. Specifically, the male terminal fittings are inserted into the cavities before the retainer is mounted into the male housing, and then the retainer is mounted at a proper mount position in the male housing to lock the male terminal fittings.

Connectors having a partial connection preventing function are shown. However, connectors having no such function (slider and compression coil spring) also are embraced by the present invention.

The invention may also be applied to watertight connectors.

What is claimed is:

1. A connector, comprising:

a male housing with a receptacle for receiving a mating female housing, the male housing having a receptacle with at least one rib insertion groove for receiving a rib of the female housing;

at least one male terminal fitting accommodated in the male housing; and a retainer mountable into the male housing and engageable with the male terminal fittings upon reaching a proper mount position to lock the male terminal fittings, the retainer including a detector located in the rib insertion groove of the receptacle for the female housing and interfering with the female housing to prevent connection of the female housing when the retainer is at a position other than the proper mount position, the detector being located outside the rib insertion groove to permit the connection of the female housing when the retainer is substantially at the proper mount position.

2. A connector according to claim 1, wherein the male housing is provided with a cut-away portion for receiving the detector when the retainer is mounted.

3. The connector of claim 1, wherein the detector is located at a front side of the retainer with respect to a mounting direction of the retainer into the male housing and with respect to a connecting and separating direction of the housings when the retainer is mounted properly.

4. The connector of claim 1, wherein a locking construction is provided for locking the male housing and the mating female housing together.

5. A connector assembly comprising the connector of claim 1 and a mating connector connectable therewith.

6. The connector of claim 1, wherein the retainer is movably mounted along a direction intersecting inserting and withdrawing directions of the male terminal fittings between a first position where the insertion and withdrawal of the male terminal fittings into and from the male housing are permitted and a second position where the retainer locks the male terminal fittings.

7. The connector of claim 6, wherein the detector is in the fitting space when the retainer is at a position other than the second position while being substantially outside the fitting space when the retainer reaches the second position.

8. A connector, comprising:

a male housing having opposite front and rear ends and a receptacle extending rearwardly into the front end of the male housing for receiving a mating female housing along a mating direction;

a plurality of male terminal fittings accommodated in the male housing and projecting into the receptacle, the male terminal fittings extending substantially along the mating direction and being arranged substantially side-by-side along a width direction normal to the mating direction; and a retainer mountable into the male housing along the width direction and being engageable with the male terminal fittings upon reaching a proper mount position to lock the male terminal fitting in the male housing, the retainer including a detector located in a fitting space of the receptacle for the female housing and interfering with the female housing to prevent connection of the female housing when the retainer is at a position other than the proper mount position, the detector being located outside the fitting space to permit the connection of the female housing when the retainer is substantially at the proper mount position.

* * * * *